US007717980B2

(12) United States Patent
Tepper et al.

(10) Patent No.: US 7,717,980 B2
(45) Date of Patent: May 18, 2010

(54) CONTAMINANT EXTRACTION SYSTEMS, METHODS AND APPARATUSES

(75) Inventors: Gary C. Tepper, Glen Allen, VA (US); Royal Kessick, Richmond, VA (US); Dmitry Pestov, Glen Allen, VA (US); Michael P. Eddy, Del Mar, CA (US)

(73) Assignee: Sentor Technologies, Inc., Glen Allen, VA (US)

( * ) Notice: Subject to any disclaimer, the term of this patent is extended or adjusted under 35 U.S.C. 154(b) by 60 days.

(21) Appl. No.: 11/276,355

(22) Filed: Feb. 24, 2006

(65) Prior Publication Data

US 2006/0185511 A1 Aug. 24, 2006

Related U.S. Application Data

(60) Provisional application No. 60/593,926, filed on Feb. 24, 2005, provisional application No. 60/743,356, filed on Feb. 24, 2006.

(51) Int. Cl.
*B03C 3/014* (2006.01)

(52) U.S. Cl. ..... 95/71; 96/27; 96/53

(58) Field of Classification Search ..... 95/64–66, 95/71, 72; 96/27, 52, 53
See application file for complete search history.

(56) References Cited

U.S. PATENT DOCUMENTS 2,583,899 A * 1/1952 Smith ..... 204/155
3,958,958 A * 5/1976 Klugman et al. ..... 95/64
3,960,505 A * 6/1976 Marks ..... 422/168
4,072,477 A * 2/1978 Hanson et al. ..... 95/71
4,095,962 A * 6/1978 Richards ..... 95/65
4,146,371 A * 3/1979 Melcher et al. ..... 95/62
4,222,748 A * 9/1980 Argo et al. ..... 95/64
RE30,479 E * 1/1981 Cohen et al. ..... 95/71
4,624,763 A * 11/1986 Chimenti ..... 204/562
5,624,476 A * 4/1997 Eyraud ..... 95/65
6,156,098 A * 12/2000 Richards ..... 95/65

(Continued)

OTHER PUBLICATIONS

Song et al., Rapid ambient mass spectrometric profiling of intact, untreated bacteria using desorption electrospray ionization, Chemical Communication, 2007 Edition, pp. 61-63, Published online at www.rsc.org/chemcomm, The Royal Society of Chemistry, Cambridge, UK.

(Continued)

*Primary Examiner*—Richard L Chiesa
(74) *Attorney, Agent, or Firm*—Michael P. Eddy

(57) ABSTRACT

A contaminant extraction apparatus, systems and method for extracting contaminants, such as particles and polar molecules, from an air flow containing a contaminated gas such as air so that the contaminants are expelled from the embodiments after they are extracted. One method includes the steps of generating two electric fields in separate air flow channels separated by an extraction grid with the second electric field having a greater potential difference than the first electric field; generating a first air flow through the first air flow channel and a second air flow through a second air flow channel; dispensing charged liquid droplets into the first air flow using at least one charged droplet generator; allowing the droplets to transfer charge to those contaminants; and expelling the contaminants into the second air flow using the potential difference in the second electric field.

21 Claims, 17 Drawing Sheets

U.S. PATENT DOCUMENTS

| | | | | |
|---|---|---|---|---|
| 6,471,753 | B1 * | 10/2002 | Ahn et al. | 96/27 |
| 6,607,579 | B2 * | 8/2003 | Willey et al. | 95/71 |
| 6,656,253 | B2 * | 12/2003 | Willey et al. | 96/27 |
| 6,986,803 | B1 * | 1/2006 | Richards | 95/71 |
| 2003/0196552 | A1 * | 10/2003 | Willey et al. | 96/44 |
| 2004/0023411 | A1 * | 2/2004 | Fenn | 436/174 |

OTHER PUBLICATIONS

Qizhi Hut al. Desorption electrospray ionization using an Orbitrap mass spectrometer: exact mass measurements on drugs and peptides, Rapid Communications in Mass Spectrometry, Published 2006, pp. 3403-3408, 2006 vol. 20, John Wiley & Sons, Ltd., Published online in Wiley InterScience (www.interscience.wiley.com).

Venter et al., Droplet Dynamics and Ionization Mechanisms in Desorption Electrospray Ionization Mass Spectrometry, Analytical Chemistry, Dec. 15, 2006, vol. 78, pp. 8549-8555, Analytical Chemistry. US.

Justes et al., Detection of explosives on skin using ambient ionization mass spectrometry, Apr. 27, 2007, 2007 Volume, pp. 2142-2144, First Published online at www.rsc.org/chemcomm on Apr. 27, 2007, Chemical Communication, UK.

Cooks, et al., Ambient Mass Spectrometry, Mar. 17, 2006, pp. 1566-1570, vol. 311 (2006) Science, American Association for the Advancement of Science, US.

Jaworek et al., Multi-nozzle electrospray system for gas cleaning processes, Jul. 12, 2005, pp. 194-202, Journal of Electrostatics vol. 64 (2006), Elsevier B.V., UK.

Jaworek et al., Modern electrostatic devices and methods for exhaust gas cleaning: A brief review, Sep. 5, 2006, pp. 133-155, Journal of Electrostatics vol. 65 (2007), Elsevier B.V., UK.

Williams, et al., The use of recently described ionisation techniques for the rapid analysis of some common drugs and samples of biological origin, Rapid Communications in Mass Spectrometry, Published 2006 vol. 20 (2006), pp. 1447-1456, John Wiley & Sons, Ltd., Published online in Wiley InterScience (www.interscience.wiley.com).

* cited by examiner

CONTAMINANT EXTRACTION SYSTEMS, METHODS AND APPARATUSES

CROSS-REFERENCES TO RELATED PATENT APPLICATIONS

This application claims the benefit of U.S. Provisional Application Ser. No. 60/593,926 Filed Feb. 24, 2005 and of U.S. Provisional Application Ser. No. 60/743,356 Filed Feb. 24, 2006, each of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND

A. Field of the Invention

Embodiments of the claimed subject matter relate to methods, systems and apparatuses for purifying air, and more particularly, to systems, methods and apparatuses for removing particles and contaminants from an air flow by attracting the particles and contaminants to charged spray droplets of a fluid introduced to the air flow.

B. Description of Related Art

The technique of electrospray ionization is well described and known to those skilled in the art. Prior art air purification apparatuses and methods include U.S. Pat. No. RE 30,479 to Cohen, et al. which illustrates a method for the removal of particulate matter as well as noxious gases and vapors from a gas stream. This is accomplished by means of charged droplets having a size between 60 and 250 microns and preferably between 80 and 120 microns. The droplets are generated by first ejecting a stable jet of liquid such as water and the liquid jet is broken up into charged droplets by applying an electric potential between the jet and the collecting walls of the scrubber.

U.S. Pat. No. 4,095,962 to Richards describes a method for producing small highly charged droplets without concurrent production of corona by conducting a liquid to a nozzle having a tip from which droplets of the liquid can exit, and forming a substantially uniform electric field over the surface of the liquid on the tip, the field being large enough to pull off droplets from the tip but not so large as to create corona discharge. Selected gas, solid particulates and liquid mists from gaseous effluents such as are produced by smelters, coal or oil-burning steam generators, chemical refineries and the like are removed by means of a unique electrostatic collector using the highly charged droplets. These droplets are caused to drift, by means of an electric field, through the gaseous effluent to a collecting electrode absorbing selected gases and aerosol particles and carrying them to a collecting electrode.

U.S. Pat. No. 6,156,098 to Richards describes a gas scrubbing apparatus and method, employing highly charged liquid droplets for removal of both particulates and pollutant gases from the gas to be cleaned, that allows scrubbing of uncharged particulates by means of monopole-dipole attractive forces between the charged liquid droplets and the electric dipoles induced in the uncharged particulates by the charged droplets. It also describes employing electrode geometry at the site of droplet production and charging, having spreading liquid sheet electrodes emitting the droplets from the edges of the liquid sheets, interspersed with electrically conductive induction electrodes, with electrostatic potential of no more than about 20 kv existing between the induction electrode array and the array of liquid sheets, and with spacing such that adequately high electric field strength can be maintained at the edges of the liquid sheets to allow adequate charging of the droplets emitted from the liquid sheets, without the occurrence of corona discharges which could deplete droplet charges or interfere with production of the electric field strength required for adequate droplet charging; allowing the particulate and pollutant gas scrubbing procedures to be carried out simultaneously in a single chamber; requiring no substantial power other than that for the blower or other means which moves the gas to be cleaned through the cleaning chamber; and allowing these results to be achieved with low liquid-to-gas flow ratios.

Next, U.S. Pat. No. 6,471,753 (Ahn, et al.) discloses a device for collecting dust using highly charged hyperfine liquid droplets formed through an electro-hydrodynamic atomization process. In the dust collecting device of this invention, a high voltage is applied to capillaries, set within a dust guide duct and having nozzles at their tips. An electric field is thus formed between the capillaries and the duct, and allows the nozzles to spray highly charged hyperfine liquid droplets. Such liquid droplets absorb dust laden in air, flowing in the duct by suction force of a fan. An electrostatic dust collector is detachably coupled to the duct while being insulated from the duct, and forms an electric field having polarity opposite to that of the highly charged liquid droplets, thus electrostatically collecting and removing the dust absorbed by the highly charged liquid droplets. The dust collecting device of this invention easily and effectively removes fine dust having a size smaller than 0.1 cm. This device is also preferably operable at low cost while achieving a desired dust collection effect, and is collaterally advantageous in that it humidifies discharged air, when water is used as the liquid for atomization of the hyperfine liquid droplets.

Willey, et al. (U.S. Pat. No. 6,656,253 and U.S. Pub. No. 2003/0196552) disclose an apparatus for removing particles from air which includes an inlet for receiving a flow of air, a first chamber in flow communication with the inlet, wherein a charged spray of semiconducting fluid droplets having a first polarity is introduced to the air flow so that the particles are electrostatically attracted to and retained by the spray droplets, and an outlet in flow communication with the first chamber, wherein the air flow exits the apparatus substantially free of the particles. The first chamber of the apparatus further includes a collecting surface for attracting the spray droplets, a power supply, and a spray nozzle connected to the power supply for receiving fluid and producing the spray droplets therefrom. The apparatus may also include a second chamber in flow communication with the inlet at a first end and the first chamber at a second end, wherein particles entrained in the air flow are charged with a second polarity opposite the first polarity prior to the air flow entering the first chamber.

U.S. Published Application No. 2004/0023411 to Fenn describes a method of collecting or "gettering" polar trace species from ambient air devoid of the need for forced convention or pumping of the air sample. This invention utilizes a specialized electrospray source, fed by a wick, which attracts and transfers surface charge from spray droplets to ambient polar molecules and particulates which migrate into the path of the electrospray jet source and the target. Collected species may be detected directly on collection surface using suitable detection methodologies or can be stored for subsequent analysis.

The Richards '803 patent (U.S. Pat. No. 6,986,803) describes a process and apparatus for gas cleaning, as in HVAC systems or semiconductor manufacturing clean rooms, for removing 99.999% of particulate and gaseous contaminants, which may be effectively used to remove and neutralize Bio-chem agents introduced by terrorists, having a first stage in which large quantities of positively charged liquid droplets are introduced into the gas to be cleaned so as to remove virtually all negatively charged particulates and at least 90% of neutral particulates and soluble gases; a second stage in which most positively charged droplets from the first stage are removed and remaining particulates are given a positive charge; a third stage in which large quantities of negatively charged liquid droplets are introduced to remove positively charged particulates and more soluble gas contaminants; and a fourth stage in which the negatively charged droplets are removed from the cleaned gas stream.

In use, known air filters used for personal protection and air purification do not allow for sufficient air circulation and heat stress is a significant issue that affects the health, safety, and operational performance of the Soldier, Marine, Sailor, Airman, and Emergency Responder. One issue is the prior art's inability to reject metabolic body heat to the environment due to the insulation characteristics of their personal protective clothing. As a result, body heat is stored, core temperature rises and operational performance can become severely impaired. In collective protection applications, mechanical filters such as High-Efficiency Particulate Air (HEPA) or Ultra Low Penetrating Air (ULPA) produce a large pressure drop and significant stress on ducting. They are not universally effective at removing various classifications of contaminants (e.g. bacterial spores versus chemicals). Finally, they are bulky and costly, requiring large blowers and the filters are consumables and, once used, must be disposed of as hazardous waste. Embodiments of the present invention attempt to address the aforementioned issues found in the prior art.

SUMMARY

In view of the foregoing, an object of the claimed subject matter is to provide extraction methods, systems and apparatuses in which contaminants, such as particles and polar molecules, may be efficiently extracted from an air flow containing a contaminated gas such as air so that the contaminants are expelled from the embodiments after they are extracted rather than being mechanically filtered or scrubbed.

In accordance with the present claimed subject matter, there is provided a first contaminant extraction method for removing contaminants from an air flow comprising: the step of generating a first electric field in a first air flow channel and a second electric field in a second air flow channel wherein the channels are separated by an extraction grid and the second electric field is of a greater magnitude than the first electric field; the step of generating a first air flow through the first air flow channel and a second air flow through a second air flow channel; the step of dispensing charged liquid droplets into the first air flow using at least one charged droplet generator; the step of allowing said charged liquid droplets to interact with particles and polar species in the first air flow so that charge is transferred to at least one particle or polar species; and the step of expelling said one or more charged particles into the second air flow using the potential difference in the second electric field.

Another aspect of the contaminant extraction method for removing contaminants from an air flow is that either the first or second air flows may consist of a gas flow comprising a gas or gas mixture other than air. Another aspect is that the electrospray source in the embodiments may be selected from one or more of the following group: a needle, wick, an emitter array, a discrete source emitter, a capillary tube fed by a wick, two or more capillary tubes of more than one diameter, and a pressure driven aerosol generator.

Another aspect is that the source of the liquid solvent used to generate droplets in the electrospray source may be selected from the following group: water and alcohol, a mixture of water and alcohol, water and an antibacterial compound, water mixed with alcohol and an antibacterial compound, water mixed with 10% alcohol and an amount of chlorine.

Another aspect of embodiments is that the magnitude of the second electric field can be approximately two to three times the magnitude of the first electric field. Another aspect of embodiments is that the output of the second air flow may be redirected to the input of the inlet of a first air flow channel. Another aspect is that the output of the first air flow channel (such as purified air) can be released into one or more of the following group: a protected area, the environment, the interior of a house, a pressurized cylinder, a canister, and another first air flow channel. Another aspect of embodiments is that the first electric field can be generated from a set of electrodes connected to the electrospray source and the extraction grid and the second electric field can be generated from an additional connection to the ground plane of the second channel.

Another aspect of the embodiments of the claimed subject matter is that the geometries of the first air flow channel and the second air flow channels may be selected from the following group: planar, coaxial, and non planar. Another aspect of the embodiments is that at least one of the air flow channels may be enclosed in a housing having an inlet and an outlet.

Another aspect of the embodiments is that the charged droplets may change from the liquid phase to the vapor phase before they encounter or reach the extraction grid. This can help retain solvent in embodiments which require the replenishment of amounts of solvent or they assist with solvent recirculation.

Another aspect of the embodiments is that the solvent may be delivered to the electrospray source from the solvent reservoir using capillary forces instead of pumps, valves or other mechanical devices.

Another aspect of the embodiments is that the housing can also include an electrical interlock so that when the housing is opened or moved, power to the electrospray source and electrical field is stopped.

Another aspect of the embodiments is that the airflow rate and charged droplet delivery rate may be correlated for greater or maximum efficiency. This correlation can be accomplished, for example, by varying the number of emitters so that the number of emitters used determines the maximum amount (in cfm) of air that can be efficiently purified.

Another aspect of the embodiments is that more than two multiple parallel air flow channels may be used. In several embodiments, the number of multiple parallel airflow channels may be dependent on the desired air flow rate.

Another aspect of the embodiments is that contaminated particles removed from the collection plate found in several embodiments may be analyzed or characterized to determine the nature or characteristics of those contaminants.

Other embodiments of the systems and apparatuses of the claimed subject matter includes a first channel having an inlet and an outlet into which a first air flow is directed, said first air flow containing a plurality of contaminants, a solvent reservoir containing a volume of solvent, a charged drop generator which uses said solvent to produce a plurality of charged liquid droplets in said first channel, a second channel with an inlet and an outlet into which a second air flow is directed, and an electric field generator for generating a first electric field in said first channel and for generating a second electric field in said second channel, wherein the second electric field is of a magnitude greater than the first electric field, and an extraction grid located between said first channel and said second channel; wherein said charged liquid droplets are dispersed into said first channel allowing said plurality of contaminants in said first air flow to become charged, and wherein said charged contaminates are expelled into said second air flow using the potential difference generated from the second electric field, and wherein said second air flow containing said charged contaminants is expelled out of the second channel outlet and a purified air flow is expelled from the outlet of said first channel.

Another embodiment of the contaminant extraction method for removing contaminants from an air flow comprises the step of directing an air flow through a channel with an air fan, the step of generating a first electric field in the channel between an electrospray source and a ground plane in electrical communication with a collector, the step of dispensing charged liquid droplets into the air flow using at least one charged droplet generator drawing solvent from a solvent reservoir, the step of allowing said charged liquid droplets to interact with particles and polar species in the air flow so that charge is transferred to at least one particle or polar species, and the step of extracting said one or more charged particles onto the collector using the potential difference in the electric field.

Other embodiments of the systems and apparatuses of the claimed subject matter include contaminant extraction systems and apparatuses for extracting contaminants from an air flow which are made up of an air flow channel with an inlet into which an air flow is directed with an air fan, said air flow containing a plurality of contaminants, and an outlet, a solvent reservoir containing a volume of solvent, a charged droplet generator at one side of the channel for using an amount of solvent to produce a plurality of charged liquid droplets in the channel, a ground plane located at the side opposite to the charged droplet generator, a collector in electrical communication with said ground plane, an electric field generator for generating an electric field in the channel between the charged droplet generator and the ground plane, wherein said charged liquid droplets are dispersed into the channel allowing said plurality of contaminants in said first air flow to become charged, and wherein once the contaminants are charged they are expelled into the collector using the potential difference generated from the electric field, and wherein said purified air flow is expelled out of the channel outlet.

BRIEF DESCRIPTION OF THE DRAWINGS

The accompanying drawings, which are incorporated in and constitute a part of this specification, illustrate embodiments of the claimed subject matter, and, together with the description, further explain the claimed subject matter. In the drawings.

DETAILED DESCRIPTION OF THE EMBODIMENTS

Figure 1:
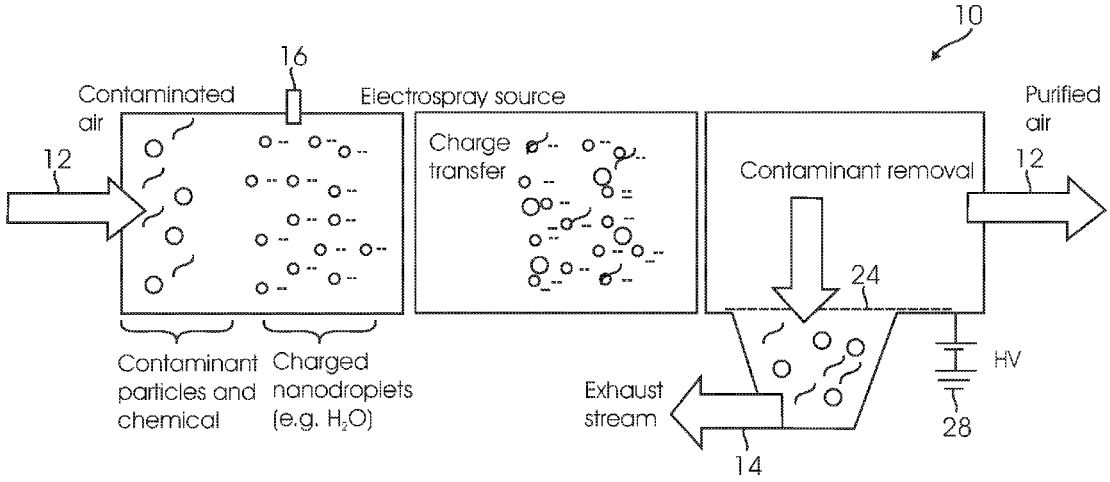
FIG. 1 is a diagram illustrating an exemplary embodiment of the air purification system.

In describing multiple embodiments of the claimed subject matter, including those embodiments illustrated in the drawings, specific terminology is employed for the sake of clarity. Although these parameters will now be discussed in further detail, these descriptions are not an exhaustive explanation of all possible variations in structure and operation. It will be apparent to those skilled in the art that various other changes or modifications can be made without departing from the spirit and scope of the embodiments presented herein. It should be further apparent that any or all combinations of the individual described variations with the disclosed embodiments are possible. Therefore, the scope of the claimed subject matter is defined by the appended claims and their equivalents.

Embodiments of the systems, methods, and apparatuses have thus far been described without reference to specific elements which may be suitable for operation. Also, as used herein, the article "a" is intended to include one or more items. Where only one item is intended, the term "one" or similar language is used.

The described embodiments include systems, methods, and apparatuses for purifying air or other gasses or gas mixtures. Embodiments of the claimed subject matter use one or more of charged droplet generators to selectively deposit charge onto any polar or polarizable contaminants in an air flow without charging the background, non-polar nitrogen and oxygen air molecules. Once charge is transferred from the charged droplets to the contaminants through a gas-phase interaction, an electrical field is used in conjunction with an extraction grid to expel the contaminants into a second air flow.

Referring now to the drawings, wherein like reference numerals refer to identical or corresponding parts throughout the several views, FIG. 1 is a diagram illustrating an exemplary embodiment 10 of the air purification system.

As shown in FIG. 1, a first air flow 12 containing particles, chemical molecules and/or other contaminants, is directed into an area where electrically charged liquid droplets generated from an electrospray source 16 selectively transfer charge onto, or "ionize", the contaminants in the air flow 12. The charged droplets deposit a charge onto the polar or polarizable air contaminants found in the first air flow 12 without simultaneously ionizing the non-polar nitrogen and oxygen components of that same air.

An extraction grid 24 and ground 28 are then used in conjunction with an electric field to extract the now charged contaminants from the incoming air flow 12 into a second air flow 14 where the charged contaminants can be directed out of the embodiment 10. The purified air (containing uncharged nitrogen, oxygen and other molecules) remains in the air flow 12 as the air flow continues out of the embodiment 10.

This embodiment as well as others can be useful with a number of contaminants such as chemical and biological toxins which have polar properties. This embodiment can also be used in the same manner with other combinations of gases and solvents suitable for similar gas-phase interactions.

The exhaust air flow, in this embodiment air flow 14, may also be directed into another area, the atmosphere, or it may be diverted back into another embodiment's incoming air flow 12. For example, the air flow 12 can be taken into the embodiment 10 from the environment and sent through the embodiment 10 with the purified air exiting the embodiment 10 into a house, while the contaminated air found in air flow 14 is diverted back into the atmosphere. Similarly, the outgoing purified air flow 12 can be directed into another incoming air flow 12 of the same or another embodiment 10 for further purification. Air flow 14 containing the contaminated air can also be directed for purification in the same or another embodiment 10. In addition, air flows, either with purified or contaminated air, simultaneously exiting from more than one embodiment 10 may also be combined and directed or diverted. Examples of areas where an air flow could be directed include another holding area, a chamber, an enclosed wearable suit, a vehicle, and a pressurized canister or cylinder.

Thus, using the described embodiments, it is possible to discriminate and convert toxins and other contaminants found in an air flow or air stream into charged species and, once converted, those ionized contaminants can be separated from the first air flow and extracted to a second air flow or air stream through the application of an electrical field, while the non-polar components of the first air flow pass through the embodiments as purified air. Several embodiments are used under the mark SELEX™. The SELEX™ term is used to identify the source of several embodiments, and does not refer to any particular embodiment. The SELEX™ terms stands for the features of "SELective" ionization and contaminant "EXTraction."

Another feature found in several of the embodiments is the presence of a negligible pressure drop, which can be a near zero level. The lack of any significant pressure drop can be beneficial in situations involving the removal of both bacterial and chemical agents. Another feature found in several embodiments is the lack of need for consumables. This can be helpful because consumable supplies for purifiers may not be readily available or they may be expensive to purchase and stock. Another feature found in several embodiments is a lack of waste because many of these embodiments do not require the use of screens of filters, which need to be thrown out and replaced or cleaned. Another feature of several embodiments is a low power requirement. Some embodiments have also very low power requirement, which can be helpful in field use or in areas where power is difficult or expensive to obtain.

Further, the contaminants found in the air flow are not absorbed or "scrubbed" out of the air flow by the liquid droplets; rather the charge is transferred using a gas-phase interaction that does not involve absorption of the contaminants into the droplets. Should it be desirable, one or more prior art absorption, mechanical, or scrubbing techniques may optionally be used in conjunction with the described embodiments to clean the purified air resulting from the first air flow. For example, any suitable air cleaner or scrubber may be used at the first air flow outlet or at the second air flow outlet once a first set of contaminants is extracted from the first air flow and expelled into a second air flow using the systems, apparatuses and methods in accordance with the claimed subject matter.

Figure 2:
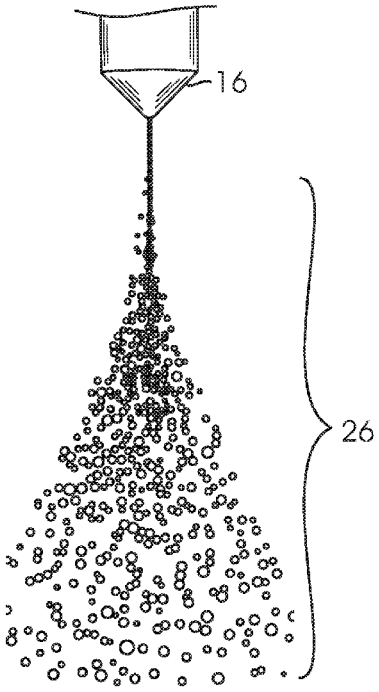
FIG. 2 is a diagram showing an electrospray charged droplet source and plume.

FIG. 2 is a diagram showing an electrospray charged droplet source and plume. In this diagram, a high voltage is applied to the tip of a capillary needle containing a liquid such as water. This needle could be substituted with any other solvent delivery device. A Taylor cone is formed at the tip of the needle through a competition between surface tension and the applied electric force. When the force from the electric field overcomes the surface tension, a fine stream of charged droplets emerges from the tip of the Taylor cone. These emerging charged droplets undergo a series of "Coulombic explosions" and divide into many smaller droplets producing a dense plume of very small, nanoscale charged droplets.

Figure 3:
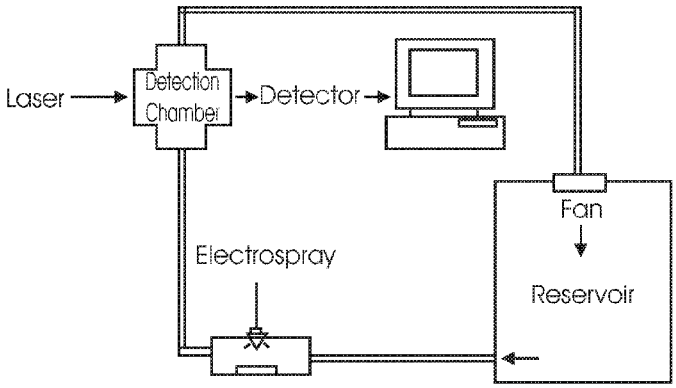
FIG. 3 is a schematic diagram illustrating the components of a prior art embodiment.

FIG. 3 is a schematic diagram illustrating the components of an embodiment including a laser, a detection chamber, a detector, an electrospray, a fan and a reservoir. This diagram illustrates these components as used in an experimental setup for the removal of micro scale particles of varying diameters from a re-circulating air stream at a flow rate of about 1 liter/minute.

Another example of an electrospray source that may be used with embodiments is a hypodermic syringe connected to a liquid reservoir and placed at a high potential, for example at several thousands of volts. Since each electrospray source used in the embodiments typically draws very little current, on the order of 100 nanoamps corresponding to about 1 milliWatt of power, the use of a large amount of electrospray charged droplet generators will use significantly less power than conventional aerosol generators. In embodiments that use a plurality of electrospray sources, such as with an array of emitters, the power savings can be beneficial. For instance, one hundred individual sources can be operated simultaneously while consuming only 1/10th of a Watt of electrical power. This allows these embodiments to operate with limited power sources over longer periods of time. Power sources such as portable batteries are sufficient to allow continued use in field applications such as portable shelters, protective enclosures or vehicles in the battlefield.

In other embodiments, capillary tubes or needles may be used. Also, capillary tubes of more than one diameter may also be used as the source of liquid droplets. Other embodiments may use one or more pressure-driven aerosol generators as the liquid droplet source or a series of wicks which can be used to effectively disperse the liquid droplets into the first air flow 18. Other embodiments may use one or more arrays of electrospray emitters, which themselves may vary in configurations.

Water is used as the solvent in the present embodiments, as it is inexpensive and non-toxic and has been shown to be effective. It is also possible to use a co-solvent such as alcohol to reduce the surface tension and increase the solution volatility, if desired. Other solvents and co-solvent, alone or in combination with other solvents, may be similarly used as a source for the droplets. For example, any liquid that can be electro sprayed and that has some amount of electrical conductivity may be used in an embodiment, for instance organic solvents and alcohol alone may be used. In addition, the conductivity can be derived from dissolved salts or contaminants, such as those found in tap water, rather than de-ionized water. It may also be advantageous to incorporate chlorine or some other antimicrobial, antifungal or antiviral additive into the liquid solvent in order to prevent the growth of mold, bacteria or any other undesirable biological compounds.

Because the emitter density and surface area of the emitter arrays should be maximized in many of the embodiments in order to maximize the collection efficiency, solvent evaporation becomes an issue. That is in many embodiments, because the solvent in the device is lost to evaporation faster than it is lost from the emitters, the solvent reservoir can be sealed to minimize evaporation while at the same time it is still in contact with the emitters which interact with the contaminated air stream. In several embodiments, the solvent/liquid reservoir (essentially a damp absorbent material) is sealed within a plastic housing and a portion of the housing is in flow communication or contact with the air flow via small holes in which the wick-fed emitters can be fed so that they emerge through interior channel side of the small reservoir holes.

The solvent may be delivered to the one or more electrospray sources using a syringe pump, gravity feed system, a wick (or wick type system,) or any combination of these methods, as well as any other method apparent to someone skilled in the art. Embodiments also possess low or nominal rates of liquid solvent consumption for an individual electrospray charged droplet generator, for example the volumetric flow rate of an electrospray source is approximately 1 to 10 microliters per minute for a capillary tube emitter and between 1 and 10 nanoliters per minute for a wick emitter. Therefore, very little liquid is expended even in a system containing a multiplicity of electrospray sources. For instance, an embodiment containing 1000 wick emitters would consume 1 microliter of solvent every minute which approximately equals 1.5 milliliter/day or 45 milliliters/month. Thus, embodiments with these emitters consume very little solvent and evaporation is the primary mechanism for solvent loss. Therefore, when used as a portable system such as a tent or military vehicle, a one gallon electrospray reservoir under continuous use would need to be refilled with water about once a month. For applications in a permanent shelter or building, the reservoir would be plumbed into the building water supply and would not require refilling.

Another feature of embodiments utilizing electrospray sources is that no ozone or electric sparks are generated during the liquid droplet generation process. In contrast, other types of generators, such as electrostatic precipitators, consume 1000 times more power than electrospray charged droplet generators. The electrostatic precipitator also generates ozone and tends to indiscriminately ionize all species including nitrogen and oxygen.

In all of the embodiments employing electrospray ionization wherein a conducting liquid is dispersed into an electric field, the exposure of the small liquid droplets to the electric field leads to rapid accumulation of charge associated with the droplets. If the electric field is strong enough, the repulsive electric forces associated with the droplets overcome the surface tension of the liquid, causing the liquid droplets to disintegrate into even smaller droplets with high charge densities. This technique and related art is known and well described in the prior art.

The liquid droplets used in the embodiments can be very small, even much smaller than the contaminants, so that they appear to be a fine mist flowing from the electrospray source. For example, the average size of the charged liquid droplets produced from an electrospray source used with the present embodiments is less than 1 micron in diameter, although any suitable size of charged liquid droplets may be used. Embodiments can also be used with charged liquid droplets typically used in other devices, such as those having 25 to 800 microns in diameter.

Embodiments may be used for purifying air in any type of environment, and they may also be used to purify air flows containing other gases or gas mixtures. Also, embodiments used for purifying air may be used in areas that are protected such as enclosed environments. Examples include a protective garment, a vehicle, a command center, a building, a portable shelter, a medical center, a clean room, and the like.

Examples of air types (or qualities) that may be purified include ambient air, pressurized air, and recirculated air. In several embodiments, the contaminants are diverted back into the atmosphere rather than being collected, and this allows the embodiments to operate under steady-state conditions indefinitely without the need to change or dispose of filters. In other embodiments, a filter or trap can be used to capture or attract contaminants in the second exhaust air flow.

The airflow rate through the first and second channels in all of the previously described embodiments is controlled by adjusting the speed of the one or more air fans which blow air through the channels. In one example, an air fan blows air through the first channel 18 at a rate in a range from about 50 cubic feet per minute (cfm) to about 250 cfm. The airspeed can be preset or determined by both the airflow rate as well as the cross sectional area of the air channel. Examples of exemplary airspeeds used with the previously described embodiments are in a range from 1 to 3 meters per second.

A housing unit or enclosure may be used to house the components of the embodiments, and the overall geometry of the apparatus can take on a variety of geometric shapes. In addition, the size of the housing and the corresponding size and geometry of the airflow channels inside the housing will depend on the application and the desired airflow rate.

In all of the embodiments the airflow rate is controlled through the various channels in order to establish and maintain the purification efficiency. For instance, a fan or a blower used in conjunction with a fixed diameter air channel may be used to accomplish this objective. The airflow rate (in cubic feet per minute or cfm) established by the fan and the cross sectional area of the air channel (in cm2) together determine the maximum air speed. For example, for a flow rate of 300 cfm (typical for an air purification system) in a circular air channel with a diameter of 10 cm, the maximum air velocity is about 15 m/s. The system can be designed to remove all contaminants at a very high efficiency (for example over 99%) using these airflow rates.

Once charged, the contaminants are extracted from the first air flow into a second air flow using an electric field. Additional electric fields may be generated and used as necessary, for instance where there are two extraction areas (and two associated extraction grids) associated with the first air flow. The electric field is applied using a set of electrodes in one of a number of various electrode geometries, structures and electric field magnitudes. Different configurations of the electrodes include a planar or parallel plate configuration and a cylindrical geometrical configuration. Contaminant extractions can be performed at a large range of values, which can be preset or set as needed according to the needs of the one or more configurations being used.

Exposure to an electric field causes the rapid accumulation of charge in the liquid droplets. If the electric field is strong enough, the repulsive electric forces associated with the droplets overcome the surface tension of the liquid, causing the liquid droplets to disintegrate into even smaller droplets with high charge densities.

Figure 4:
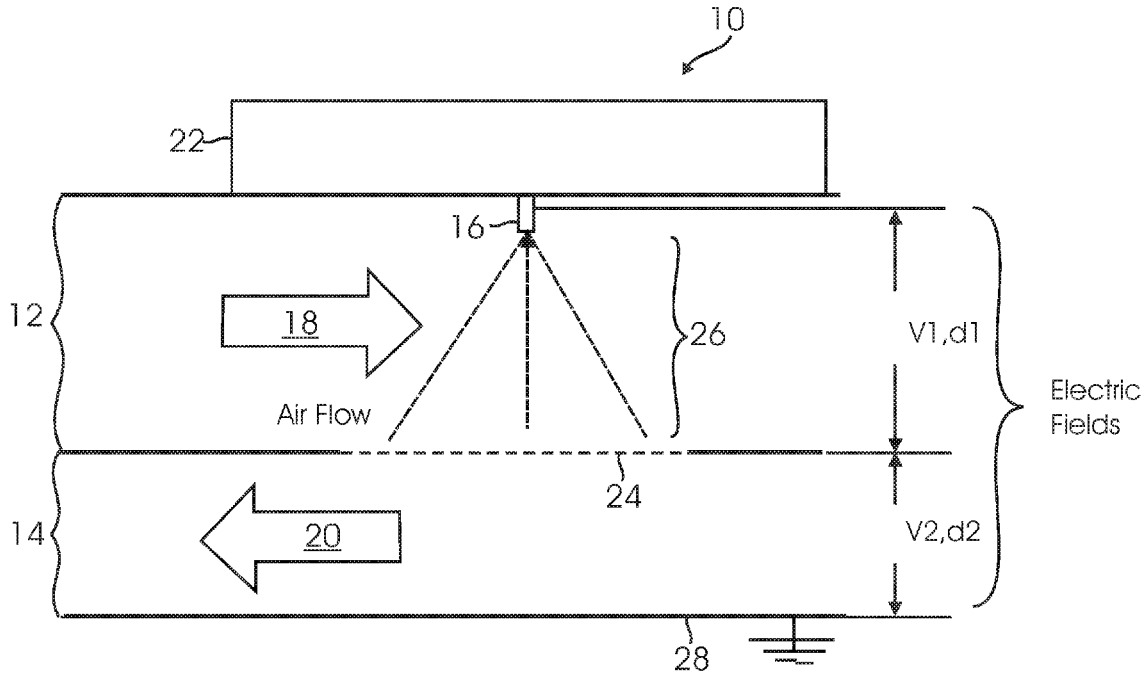
FIG. 4 is a schematic diagram illustrating the components of an embodiment of the claimed subject matter.

FIG. 4 is a schematic diagram illustrating the components of an exemplary embodiment using two different field regions. The first region containing the electrospray source 16 is the located in the first air flow channel 12. The solvent reservoir 22 is located above the source 16 and the general direction of the liquid droplet spray is indicated by numeral 26. The contaminants incoming to the embodiment 10 via air flow 18 become electrically charged inside this channel 12. The electric field in this region is determined by the voltage applied between the electrospray source 16 and the extraction grid 24 as well as the source-to-grid distance (indicated as V1, d1 in FIG. 4.)

The electric field located in the second channel 14 of FIG. 4 (which also contains air flow 20) is determined by the potential difference between the extraction grid 24 and the ground plate 28. Efficient charge extraction results have been realized when the electric field magnitude in the second channel 14 is about two to three times larger than the field in the first channel 12. The charged contaminants are accelerated toward the grid 24 by the field in channel 12 and then are pulled into the second air flow 20 by the larger magnitude field found in channel 14.

The extraction grid 24 can be formed from a wire mesh or screen made out of a non-corrosive metal, with varying qualities. For example, a material with a very fine mesh with an optical transparency less than 50% may be used or a material with a coarse mesh with a high optical transparency similar to the quality and consistency of a screen door may be used. The extraction grid 24 serves as an electrode to control the electric field magnitude in the two air channels, while at the same time allowing ionized species to pass from the upper channel to the lower channel. In this embodiment, the voltage applied to the grid 24 is selected such that the electric field magnitude in the lower channel 14 is at least twice the magnitude of the field in the upper channel 12 such that the ionized species are transported through the grid 24 but at the same time do not collect on or attach to the grid 24. In this embodiment, the grid 24 is dry and the housing and grid 24 are both supported within a frame made of an insulating material such as plastic similar to the configuration of a screen door. Many of the embodiments use grids 24 which are non-corrosive, for instance constructed of stainless steel wire mesh or screen. Additionally, the grid 24 should have approximately the same surface area as the electrospray source, for example in the case of an emitter array it should have the same surface area as that emitter array. Since high voltage is applied to the grid 24, it should also be insulated to prevent current leakage.

Once extracted into the second air flow 20, the contaminants can be expelled out of the embodiment 10. The first air flow 18 and the second air flow 20 may be driven with any suitable air fan (not shown) or any other suitable mechanism. The exhaust air, including the extracted contaminants, such as particles, chemicals or any other polar molecules or polarizable species, may be expelled into the atmosphere, a storage chamber, compressed air from a tank, recirculated air in a building or clean room, or it may be further scrubbed or cleaned by mechanical filters or even by one or more other embodiments of the present claimed subject matter. In the present embodiment, the extracted contaminants are diverted into the second, separate air stream so that instead of being collected or accumulated, the extracted contaminants are expelled into the atmosphere. Other embodiments may use flows or streams that contain gases or gas mixtures other than air.

Figure 5:
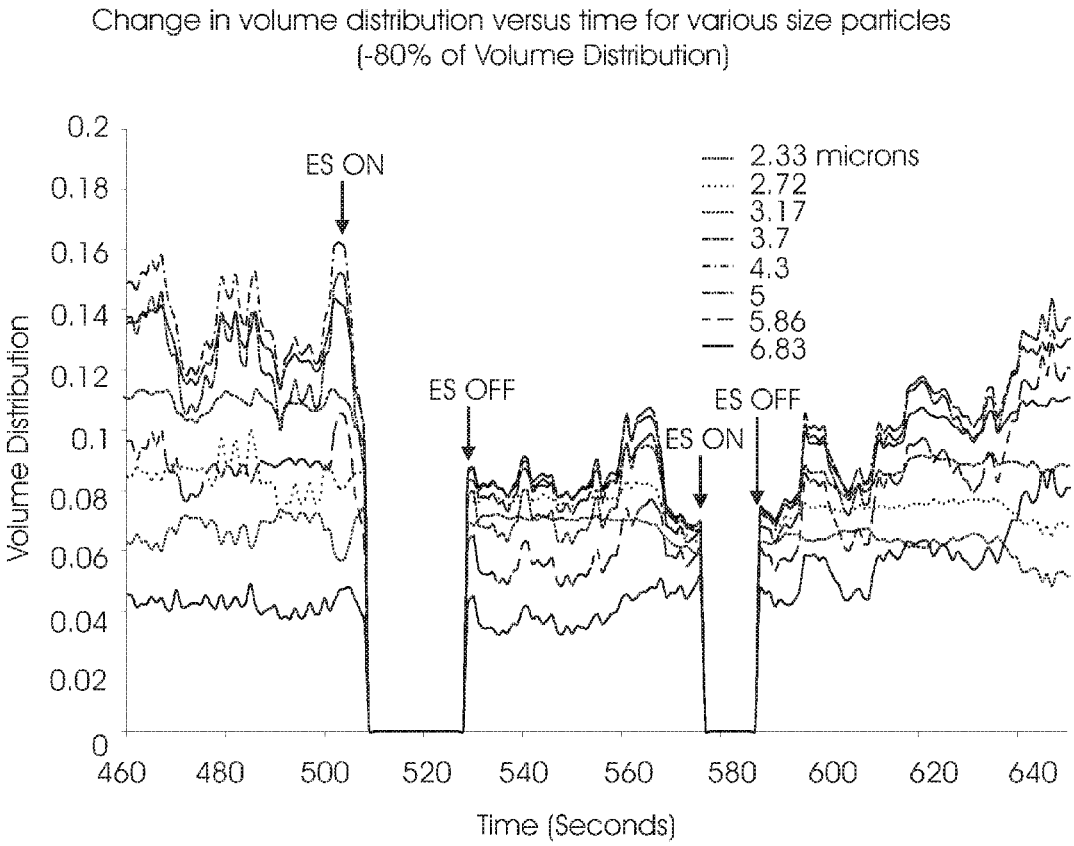
FIG. 5 is a plot of the change in volume distribution versus time for various size particles.

FIG. 5 is an illustration of a plot of the volume distribution of the particles versus time for particles ranging in size from about 2 to 7 microns in diameter. The particles were dispersed into the air stream and directed first through a chamber containing a single electrospray source and then onto a detection chamber containing a laser particle scattering system. In the experiment leading to these results, the electrospray source was cycled on and off for two brief time periods initiated at about 528 and 576 seconds. During these two time periods, the number of particles emerging from the electrospray detection chamber was reduced to a level below the detection limit of the laser scattering system. One skilled in the art will appreciate that it is possible to use other molecules, such as volatile organic molecules, to obtain a distinct set of results correlated to those molecules.

Figure 6:
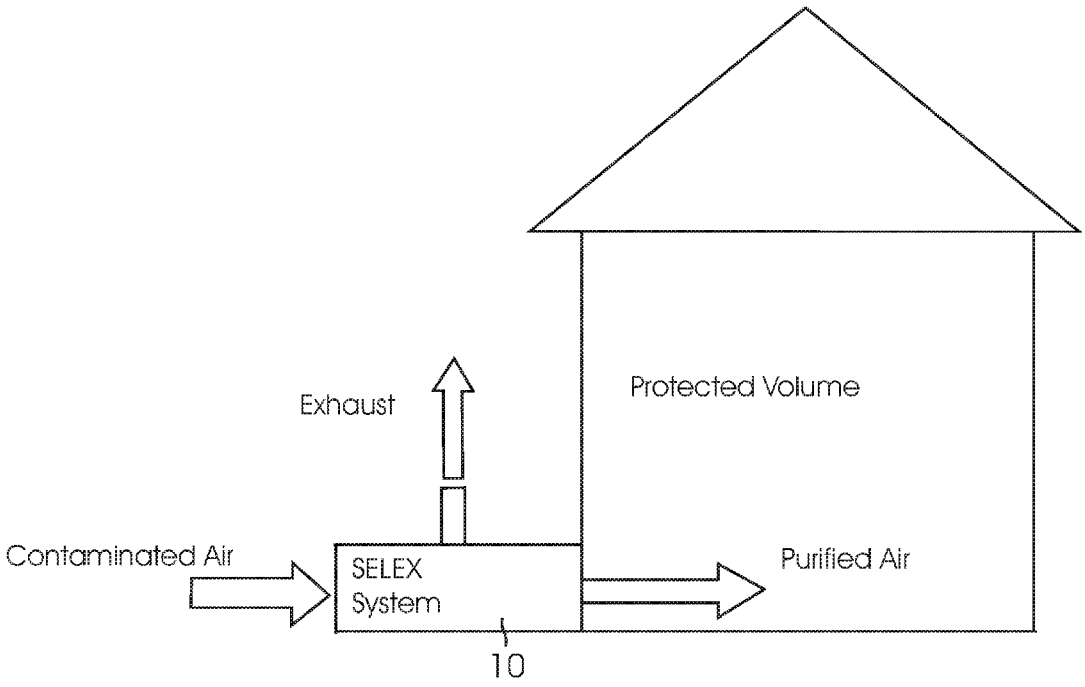
FIG. 6 is a schematic diagram showing an embodiment of the claimed subject matter in operation.

FIG. 6 is a schematic diagram illustrating how an embodiment 10 can be used in conjunction with a protected volume to produce purified air from contaminated air.

Figure 7:
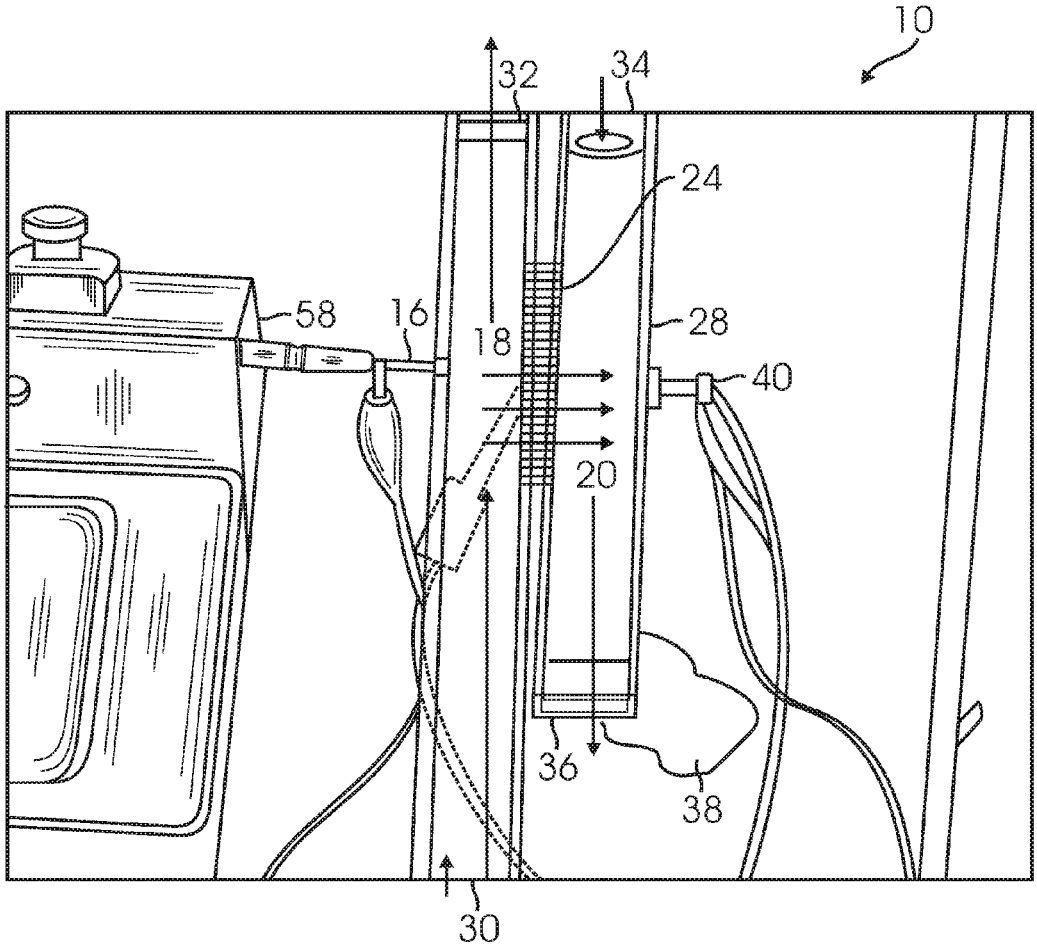
FIG. 7 is an illustration of an embodiment of the claimed subject matter.

FIG. 7 is an illustration of another embodiment in which cigarette smoke is used as the contaminant. It shows how the pathways of the airflows and where the smoke is extracted into the second air flow 20 as well as where the smoke is dispersed after it has been extracted from the first air flow 18. First, the smoke enters the first channel 18 (shown as the left channel in FIG. 7) at inlet 30 and is charged in the central region of channel 18 near the electrospray source 16. The electrospray source 16 is connected to the electrospray generator 58 and the ground plate 28 is connected to the ground 40. The charged smoke, consisting of both particles and molecules, is extracted through the extraction grid 24 into the counter-current channel 20 where it is expelled at outlet 36. The purified air flow in channel 18 exits the first channel at outlet 32 and the contaminated air flows into the dispersion area 38. The experiments have shown that the smoke can be efficiently extracted from the air flowing into the first air channel 18 and the purified air stream exiting from outlet 32 does contain only nominal amounts of residual contaminants.

Figure 8:
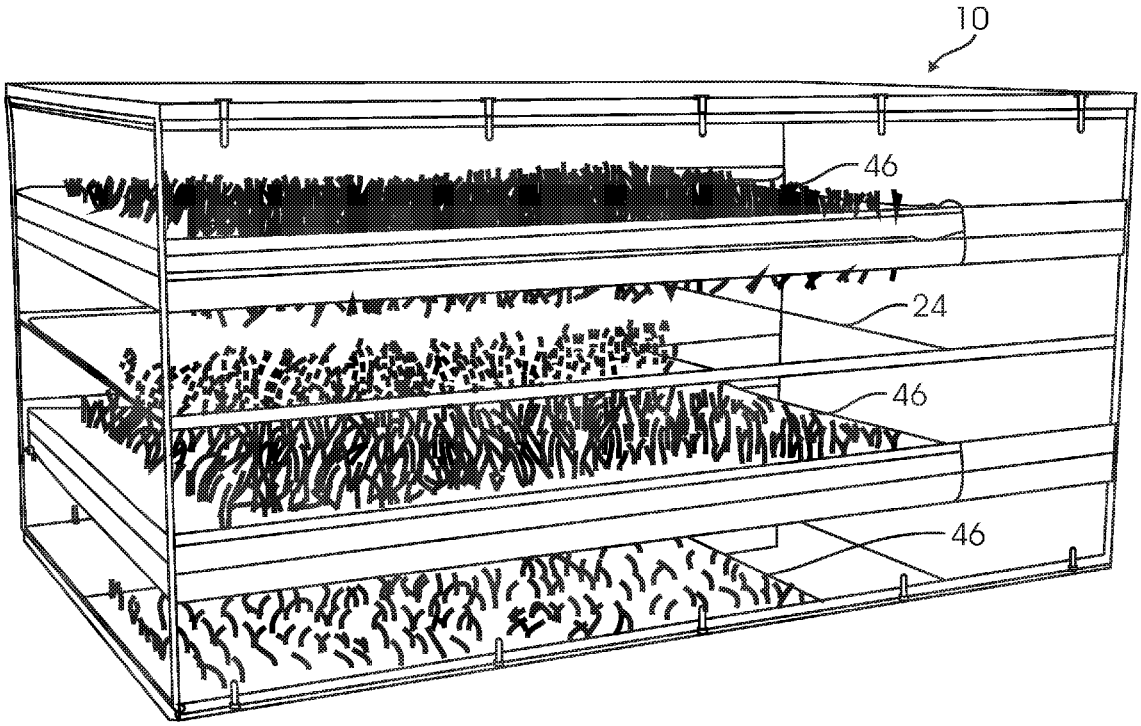
FIG. 8 is an illustration of another embodiment of the claimed subject matter.

FIG. 8 is an illustration of another embodiment of the claimed subject matter with an alternate configuration having three electrospray emitter arrays 46 and at least one extraction grid 24.

Figure 9:
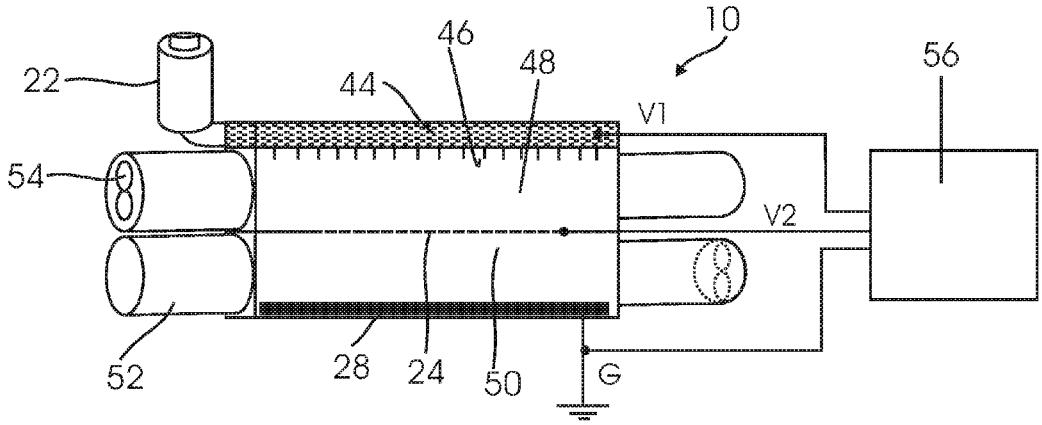
FIG. 9 is a schematic diagram of another embodiment of the claimed subject matter.
Figure 10:
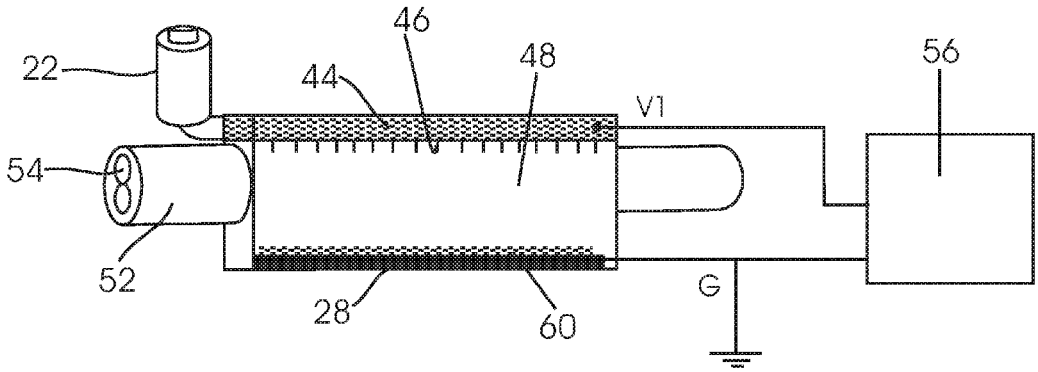
FIG. 10 is a schematic diagram of another embodiment of the claimed subject matter.
Figure 11:
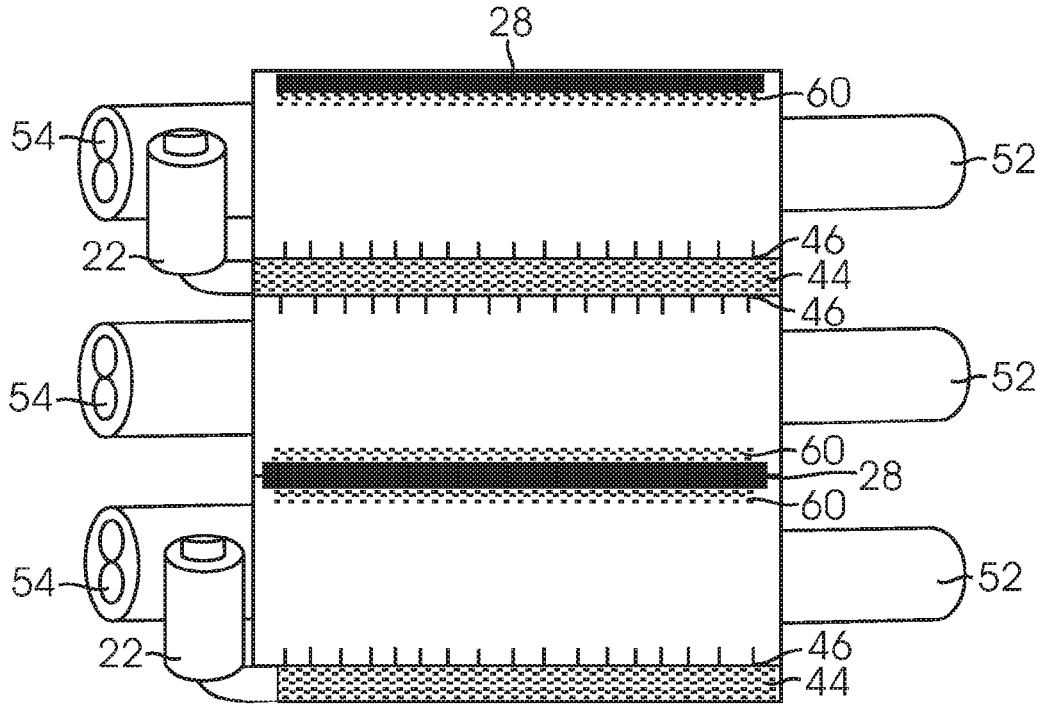
FIG. 11 is a schematic diagram of another embodiment of the claimed subject matter.

FIGS. 9-11 are schematic diagrams of three different embodiments of the claimed subject matter. In these embodiments, a structural housing unit encloses the components of the embodiments and the unit is shaped in a rectangular configuration. Additional embodiments include enclosures, housings and chambers with planar as well as cylindrical geometries. Other shapes and geometries may also be used for the housing, enclosures and channels to suit a particular desired embodiment configuration. Similarly, the ground plate and extraction grids may be made in any similar shape. The housing itself may be constructed of a polymer such as molded plastic, a glass or carbon based material, or it may be constructed of any other suitable material, such as a textile fabric material adapted for personal use in the field. An air fan 54 is shown in FIGS. 9 and 10 configured to initiate and/or direct the one or more air flows through the air flow channels in the air duct 52. Similarly, air fans (not shown) can also be used to blow air out of the exhaust air ducts.

The contaminated air enters the upper air duct channel 48 with the aid of the fan 54 which precisely controls the rate of airflow through the first channel. A second air fan would similarly precisely control the rate of airflow through the second channel. The airflow rate, as previously mentioned, is used to establish and fix the purification efficiency of the embodiment.

A filter may be included adjacent to the inlet adjacent to fan 54 shown in FIG. 9 in order to help prevent air particles greater than a specified size from entering the embodiment. The tiny liquid droplets derived from the volume of solvent stored in reservoir 22 are dispersed from an array of electrospray source emitter array 46 into the contaminated air flow in the upper duct which is being driven through the channel in the air duct by air fan 54. While in the upper chamber, the charge is transferred from the droplets to any polar or polarizable (e.g. ionic) contaminants in the air flow and the charged or "ionized" contaminants are then accelerated toward a wire mesh extraction grid 24 by an electric field that is established between the electrospray emitter array 46 and the extraction grid 24. The magnitude of the first (upper) electric field is determined by (a) the voltages applied to the solvent at the emitter source 46 (referenced as V1 in FIG. 9) and applied to the extraction grid 24 (referenced as V2 in FIG. 9) and (b) the distance between the electrospray source emitter array 46 and the extraction grid 24. Upon reaching the extraction grid 24, the charged contaminants are pulled through the grid into a second "exhaust" chamber (as previously described) by a second (larger) electric field established between the extraction grid 24 and a ground plane 28. An electric field magnitude of approximately 1 kV/cm is typically needed to sustain an electrospray process and this magnitude establishes the field magnitude in the upper channel. The magnitude of the electric field in the second air flow channel is based on the upper first air flow channel magnitude and it should be at least two to three times (2×-3×) the magnitude of the electrical field located the first air flow chamber in order to attract the ionized species through the extraction grid 24 into the second air flow exhaust chamber as well as to minimize the collection of any material on the grid 24. The magnitude of the second, lower chamber electric field is similarly determined by the voltage (V2) applied at the extraction grid 24 and by the distance between the extraction grid 24 and the ground plane 28.

In this embodiment, the voltage applied to the emitter array 46 is 20,000V and the voltage applied to the grid 24 is 15,000V. The distance between the plane on which the emitter array 46 site and the grid 24 plane is 5 cm and the distance between the grid 24 and the bottom ground plane 28 is also 5 cm. Therefore, in this embodiment, the electric field magnitude in the upper channel is 1000V/cm and the electric field in the lower channel is 3000V/cm resulting in an electric field ratio of 3/1.

A single high voltage power supply 56 may be used to apply the voltages V1 and V2 to the components. The first and second air flow channels are in flow communication but are separated only by the wire mesh extraction grid 24 which, as previously described, acts as an electrode to control the electric field magnitude in the two air flow channels, while at the same time allowing ionized contaminants to pass through the grid 24 from the first air flow channel to the second lower air flow channel. As such, the grid 24 in most of the embodiments has a high electrical conductivity and must be coarse enough to allow air and any charged particles to flow freely through it without causing a change in air pressure within the embodiment.

Once the ionized contaminants pass through the grid 24 and reach the lower air channel, they are expelled back into the environment.

The remaining non-polar components of the first air flow, such as nitrogen and oxygen, do not get ionized by the charged liquid droplets so they pass through the first air flow channel and are expelled as "purified air" through another outlet typically entering a protected air volume that is isolated from the exterior air.

As in other embodiments, the purified air from the protected volume may be recirculated back into the embodiment through a separate inlet that is distinct from the initial exterior air inlet. Because this second inlet is not in flow communication with the initial exterior air, it would allow further purification of the protected air volume. Because the contaminants in this embodiment are expelled in the exhaust stream, and because neither the exhaust stream nor the ambient air is in flow communication with the protected volume of purified air, there is no need for collection of the contaminants. However, if the air purification apparatus is to be used in a setting where the ambient air and the purified air are to be in flow communication, it may be desirable to collect the contaminants within the apparatus rather than expelling them back into the ambient air as "dirty" exhaust. Another embodiment, in which the ionized air contaminants are collected and retained within the apparatus, is illustrated in FIG. 10.

Referring now to FIG. 10, another embodiment using a collector 60 or a collecting surface 60 in order to attract and accumulate the air contaminants after they have been ionized by the electrospray droplets in the single channel 48. In this embodiment, the contaminated air flow is directed through channel 48 by an air fan 54 as previously described. Ionization of the polar air contaminants by the charged droplets leads to the acceleration of the ionized contaminants toward the collecting surface 60 due to the electric field located in the channel 48. The magnitude of the electric field is determined by the voltage (V1) applied at the electrospray emitter array 46 and the ground plate 28 as well as the distance from the emitter array 46 to the collecting surface 60. The collecting surface 60 is a material located on top of and in electrical contact with the bottom ground plane 28.

In this embodiment with a single air flow channel and no grid 24, the voltage applied to the emitter array 46 is 5000V and the electric field magnitude in the single 5 cm wide channel is 1000V/cm. Since very little current is used in this device, the high voltage can be supplied using a battery in combination with a DC/DC high voltage converter, which would be useful in portable embodiments. In non portable embodiments, normal household 110*ac* could be used in conjunction with a high voltage transformer to supply the high voltage to the embodiment.

Collector surface 60 should cover the entire surface of the ground plane 28 and should have sufficient electrical conductivity to prevent charge accumulation. For the removal of particles such as dust, bacteria, mold, pollen, and pet dander, the collector 60 may simply consist of a metal plate which is periodically wiped off. Alternatively it can be similar to a filter used in a home HVAC system that is removed and cleaned or replaced/changed periodically. Since the particles do not have any vapor pressure, once they are collected they will not return to the air. In contrast, for chemicals and other volatile species, the collector 60 should be constructed with a material having a chemically reactive species such as activated carbon. The collector 60 does not need to be charged but it should be connected to the bottom ground plane 28 on which it makes contact and sits so that it can be discharged. In this embodiment, as in the previous embodiment illustrated in FIG. 9, non-polar components of the incoming air flow are not ionized by the electrospray liquid droplets, and as such they pass through the channel and out the outlet as purified air. Because this embodiment does not utilize an extraction grid 24, as previously described or a second air flow channel for the exhaust, it also does not use a second electric field.

In contrast to the previous embodiment which is comprised of a single air flow channel or duct in which the single contaminated air flow becomes ionized and purified, FIG. 11 illustrates another embodiment having multiple air flow channels which are incorporated into the housing of the embodiment. In this embodiment, all of the elements are identical to those shown in the embodiment illustrated in FIG. 10 except that a single housing unit encloses multiple single air flow channels 52. Each air channel 52 has its own inlet with an air fan 54, electrospray emitter array 46, collector 60, and outlet for the air to pass through once it is purified. As shown in FIG. 11, due to the parallel or anti parallel nature of the air channels 52, the configuration of the adjacent chambers requires that the two lower channels share a single ground plane 28. Additionally, the two upper channels share a solvent pad 44.

In this embodiment, the capillary flow of liquid from the solvent pad 44 through a set of wick electrospray sources 16 obviates the need for a pump or other driving force for the movement of the liquid solvent through the electrospray source into the channels. The rates of capillary flow and droplet dispersal from the emitter array 46 are controlled by the number of wicks and by the strength of the electric field in the first air flow chamber (i.e. the values of V1 and the distance inside the channel between the two electrodes.) For example, the flow rate and droplet dispersal rate will increase if either the number of wicks or the electric field magnitude is increased. Similarly, the flow rate and the dispersal rate will decrease if either the number of wicks or the electric field magnitude is decreased. Additionally, the size of the charged liquid droplets is also controlled by these same parameters, but with a slightly different relationship, which would be apparent to one skilled in the art. Thus, the size of ionizing liquid droplets can be easily manipulated and controlled by varying the voltage (V1) applied at the solvent pad 44. In use, the charged droplets formed from the electrospray source 16 should be small enough (e.g. under one micron in diameter) so that the solvent evaporates in the electric field of the first chamber before reaching the extraction grid 24 or the collector 60. Controlling the size of the liquid droplets will prevent accumulation of solvent within the embodiments. As with the droplet size parameter, the rate of evaporation of the solvent droplets will also depend on the magnitude of the electric field as well as the volatility of the liquid solvent. In this embodiment as well as the others, the liquid solvent is replaced at a rate similar or equivalent to the rate at which the solvent is consumed by both the electrospray sources 16 and by the process of evaporation.

Alternate configurations include adjacent channels or chambers that share a single liquid reservoir 22 and a solvent pad 44 that can feed the wicks of the electrospray emitter arrays 46 on opposing sides of the solvent pad 44. In other embodiments, a single solvent reservoir 22 can feed all of the solvent pads 44 and their corresponding electrospray emitter arrays 46 within a single housing unit or enclosure. Other variations and embodiments could allow other components of the system to be shared by multiple channels or chambers. For example, a plurality of channels can share a single inlet, outlet or air fan 54. Other embodiments can include multiple parallel or antiparallel air flow channels or chambers as well as multiple parallel or antiparallel exhaust chambers within that single embodiment. Also, adjacent air flow channels or chambers may share other components (i.e. inlets, outlets, solvent sources, ground planes, etc.) with one another in a variety of different configurations.

In another embodiment of the apparatus, the electrode planes can be arranged in a cylindrical, coaxial geometry rather than in a planar configuration as previously described. In a coaxial configuration, the electrospray source emitters 16 emerge from a central cylinder with the collector 60 positioned on the inside surface of the outer cylinder. The contaminated air stream flows through the embodiment in the annular region between the cylinders. Thus, the annular region is the first air flow channel in this configuration. Alternatively the electrospray source 16 can emerge from the inside surface of the outer cylinder with the collector 60 positioned on the opposite side of the channel on the outer surface of the inner cylinder. The solvent pad which feeds the source or emitter array from the solvent reservoir would be positioned either inside the inner cylinder or outside the outer cylinder, depending on where the electrospray emitters are located. The cylindrical, coaxial geometry could also be applied to the version of the apparatus with two air chambers and an extraction grid, similar to the embodiment shown in FIG. 9. In such an embodiment, the emitters would be located on the inner surface of the outer cylinder pointing inward, and an inner cylinder would separate the outer chamber from an inner exhaust chamber. The ground plane would be located at the center of the concentric cylinders, and the extraction grid would be located at the wall separating the outer annular chamber from the inner exhaust chamber. The inverse setup with the emitters on the outside of the inner cylinder and the ground plane at the outer cylinder is another possible variation. As described above for the planar geometries, multiple cylindrical airflow chambers could be incorporated into a single apparatus in a parallel or anti-parallel fashion.

Figure 12:
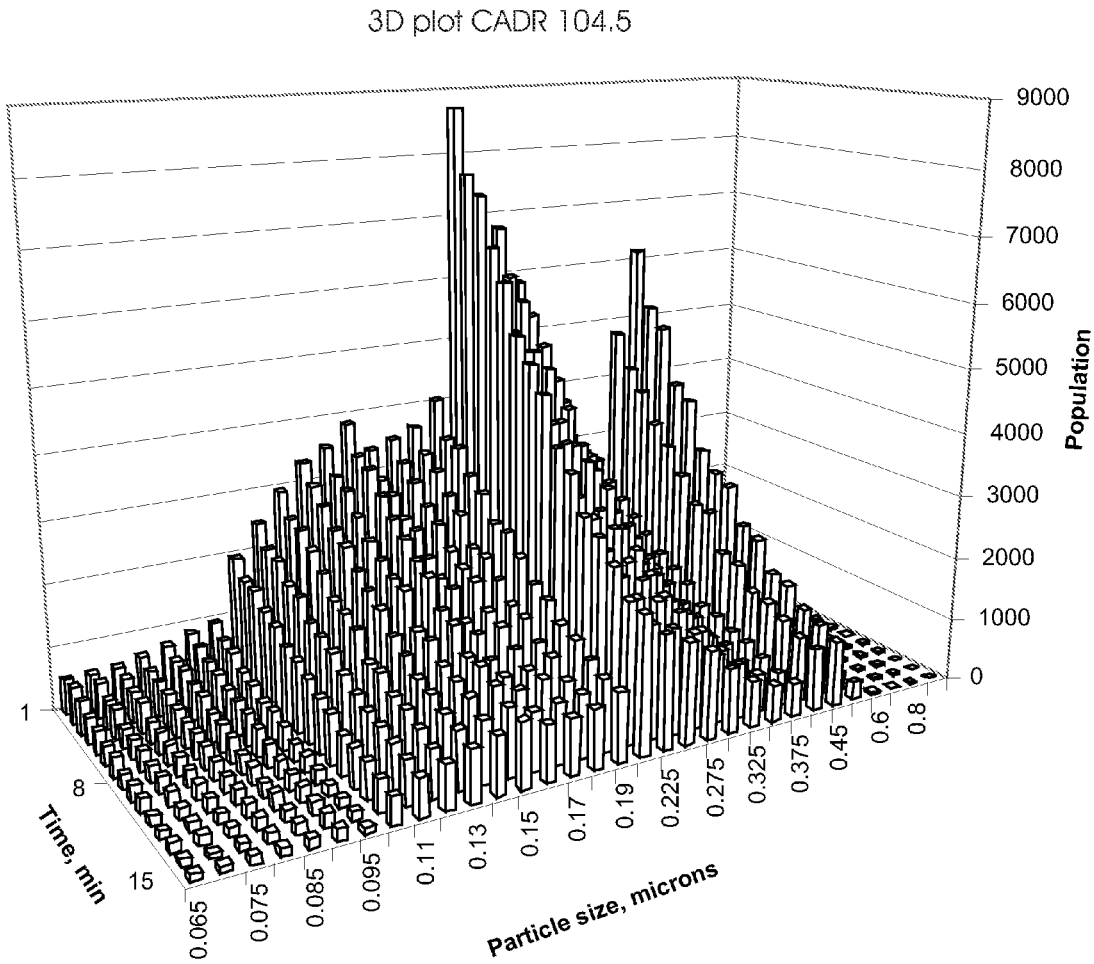
FIG. 12 is a plot of the particle population versus time in accordance with an embodiment of the claimed subject matter.
Figure 13:
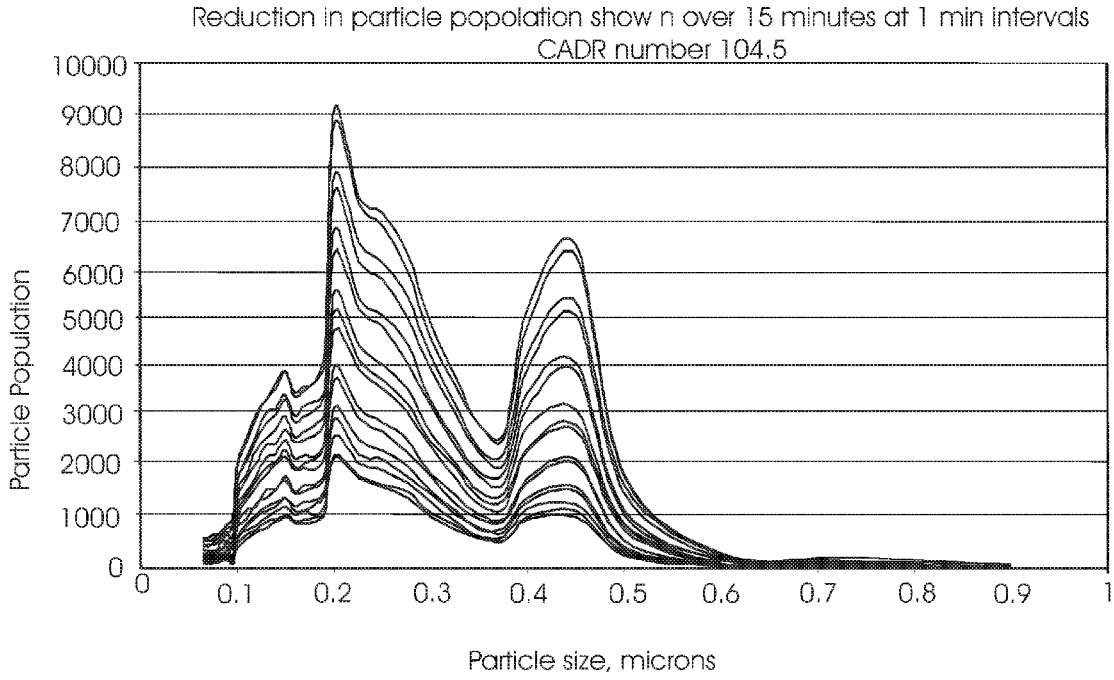
FIG. 13 is a two dimensional plot using the data of FIG. 12 showing particle population versus particle size.

Experimental results have shown that the described embodiments are well suited for removing a variety of types and sizes of contaminants. For example, FIG. 12 is a plot of the particle population versus time for a 15 minute test. In this test, the contaminant particle size ranges from 0.065 microns to 0.9 microns. This range of sizes is representative of cigarette smoke particles. FIG. 13 is a two dimensional plot using the data of FIG. 12 showing particle population versus particle size. The illustrated data lines track the reduction in particle size versus time for a 15 minute embodiment operation. The particle population shown also represents exemplary data that may be compared to cigarette smoke.

Figure 14:
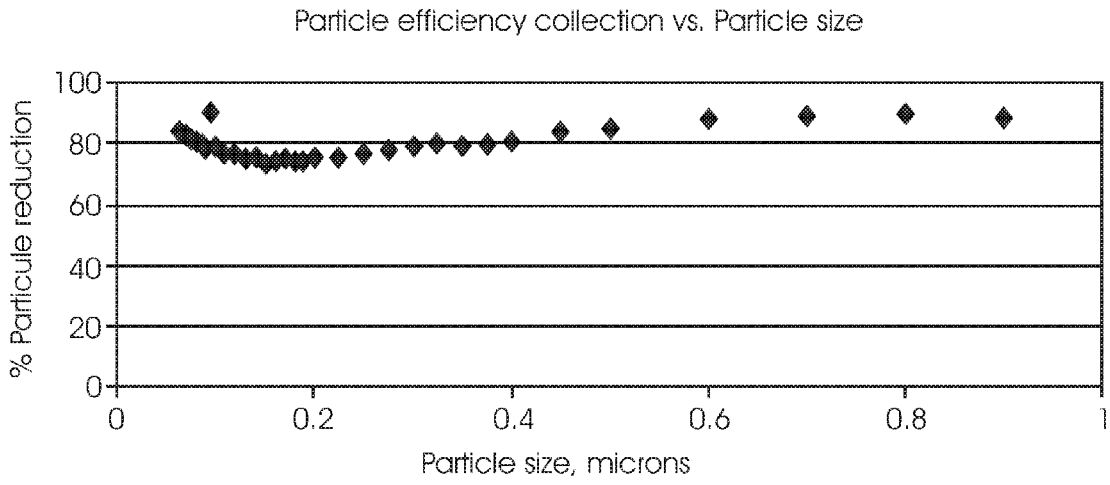
FIG. 14 is a plot illustrating the percent particle reduction versus particle size over time.

FIG. 14 is a plot illustrating the percent particle reduction versus particle size over a 15 minute test run, where the particle population is for cigarette smoke.

Figure 15:
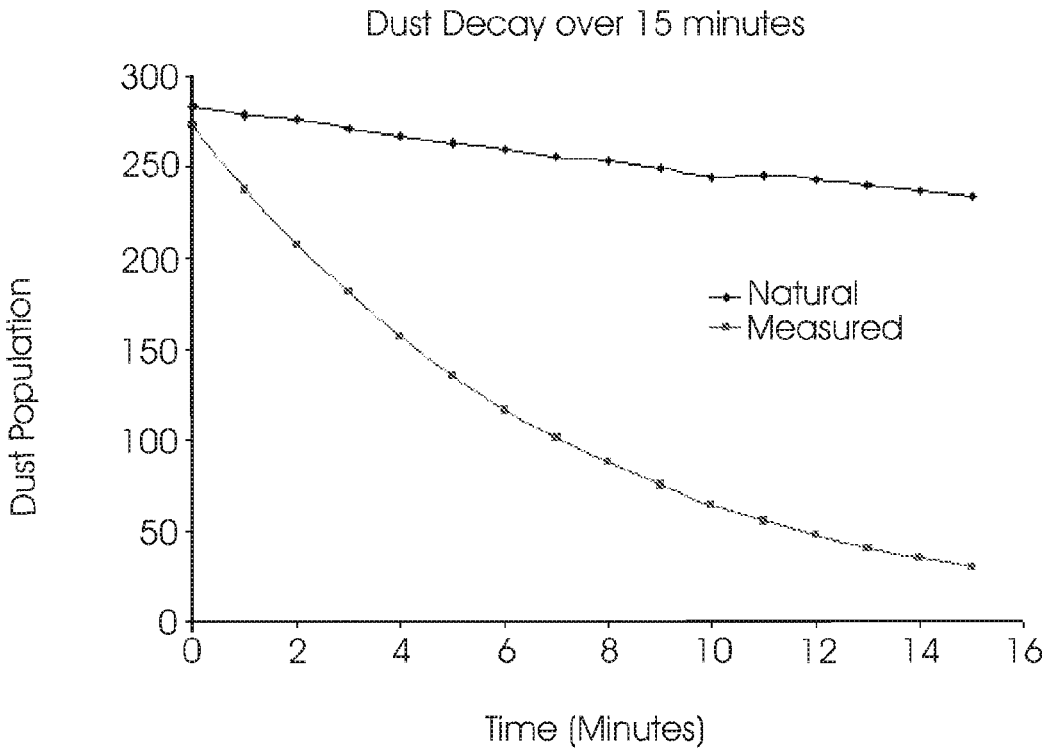
FIG. 15 is a plot of particle population versus time in accordance with an embodiment of the claimed subject matter.

FIG. 15 is a plot of particle population versus time for Arizona road dust wherein the exemplary particle size ranges from 0.5 microns to 3 microns. This test was conducted over a time period of 15 minutes.

Figure 16:
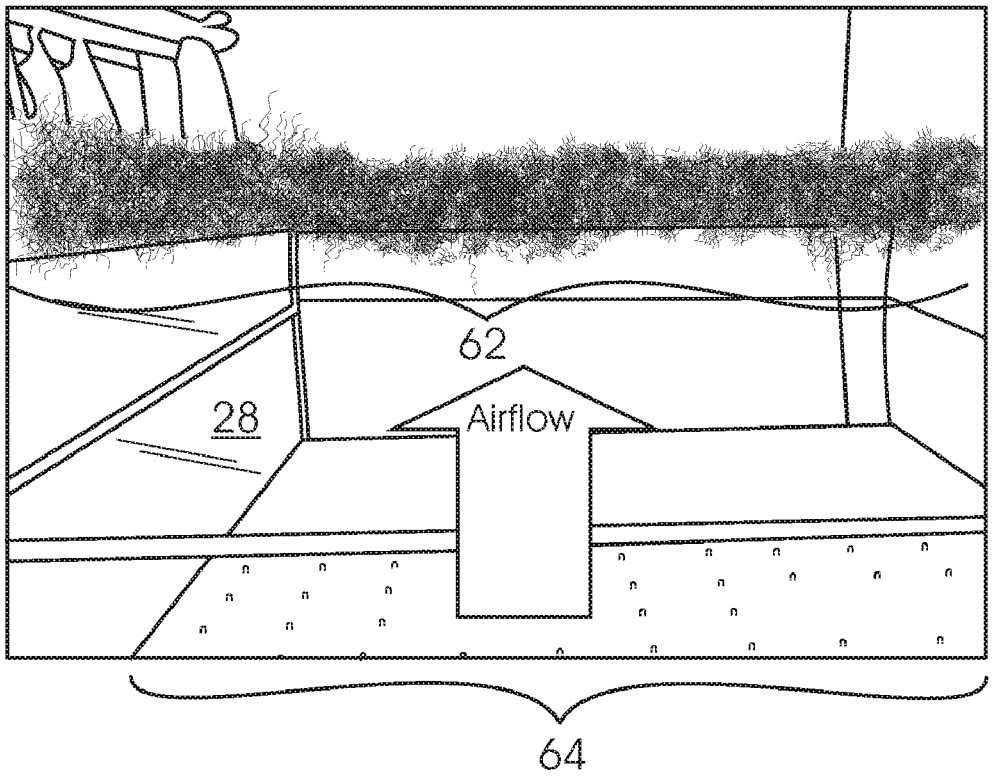
FIG. 16 is an illustration of another embodiment of the claimed subject matter.

FIG. 16 shows an alternative embodiment of the claimed subject matter with a plurality of charged nanodroplets emitted from a plurality of fibers protruding from a cashmere fabric. FIG. 16 also shows the use of a set of discrete charged droplet emitters 62. The fabric element may be made of either woven or non-woven fibers of natural (e.g. cotton, wool) or synthetic (e.g. nylon) materials, as these fabrics can be used as sources of charged nanodroplets.

The surface of the fabric includes a multitude of fibers that protruding from the surface, with each of the fibers capable of functioning as an individual charged droplet emitter. A solvent such as water is added to the fabric, and a potential difference (voltage) is applied between the fabric and a counter electrode.

The applied potential difference produces an electric field and the magnitude of the electric field is concentrated at the tip of each of the protruding fibers. When the electric force on the liquid in the fiber exceeds the surface tension, a stream of charged droplets is emitted from the tip of the fiber (i.e. an electrospray process). FIG. 16 is an illustration showing a comparison of the randomly arranged fiber emitters 62 from a natural fabric to a discrete set of charged droplet emitters 64. In this example, FIG. 16 shows a cashmere fabric with fibers protruding in all directions. Specifically, a group of individual fibers can be seen pointing down toward the metal counter electrode 28 in response to an externally applied potential difference. An array of discrete charged droplet emitters can be seen at the bottom of the photograph and consist of a nylon fiber threaded through a glass capillary tube.

In air purification embodiments using fabric as the source of the charged droplets, the increased number of individual fibers found in the fabric structure acting as charged droplet emitters results in a higher air purification rate as compared to other groups of discreet charged droplet emitter arrays. The use of fabric as a source of charged droplets helps reduce the number of steps in the manufacturing of the embodiments as compared to other embodiments not employing fabric as a source of charged droplets. Some types of fabrics to be used as a source of the charged droplets may also be flexible and, as such, can be easily formed into embodiments of a number of different geometries, such as cylindrical, round or curved or any other suitable configuration. For example, air purification systems containing electrodes in both parallel-plate or cylindrical geometries can be produced. In this illustrated embodiment, a square piece of cashmere is cut into a 20 cm by 20 cm section and wetted with a 10% ethanol-water solution. The moist fabric is then wrapped around a metal plate and placed at a high potential (approximately 20 kilovolts) with respect to a second grounded counter electrode 28.

The two plates are separated by a distance of approximately 5 cm in a configuration so that they are aligned and in parallel. A fan is used to blow air between the plates and sheets of insulating plastic are used as side walls to fix the distance between the plates and to force the air to move between the plates. In tests, cigarette smoke was added to the air flowing between the plates. When no voltage was applied between the plates the smoke traveled through the plates and emerged from the downwind side. However, when the voltage applied between the plates exceeded a critical value necessary to pull charged droplets from the fibers protruding from the fabric, a substantial portion of the smoke was effectively charged and collected on the grounded counter electrode. A substantial amount of smoke was also not shown to emerge from the downwind end of the device. Therefore, in this embodiment using a fabric as the charged droplet emitter array, the magnitude of the voltage necessary to pull the charged droplets from the fibers depends on the distance between the parallel electrodes and the length and diameter of the protruding fibers as well as the surface tension of the liquid.

Figure 17:
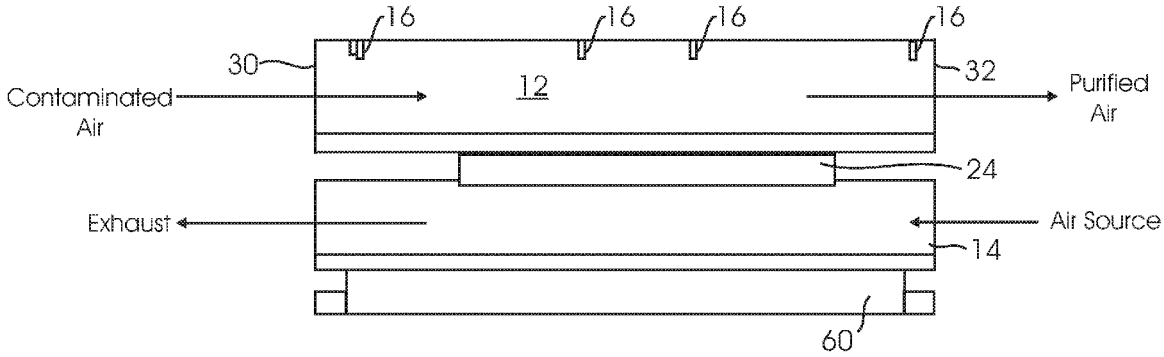
FIG. 17 is a diagram of another embodiment of the claimed subject matter.

FIG. 17 illustrates another embodiment with a planar surface geometry and with the electrospray sources 16 above the extraction grid 24. Similarly, the first air flow channel 12 is above the second air flow chamber 14. In such a configuration, the multiple discreet electrospray sources 16 generate the liquid droplets which flow into the air flow channel 12, charge the ionized contaminants and flow downward toward the extraction grid 24, where the downward direction is defined as the direction of the force of gravity. However, alternate configurations can be envisioned wherein the droplets and ionized contaminants would be directed upward from an electrospray source 16 at the bottom of the second air flow channel 14 toward the extraction grid 24, or a collector 60 which would be located at the top of the air flow chamber 12. For a two chamber embodiment, the exhaust chamber would thus be located above the first air flow chamber, with voltages V1 and V2 still being applied to the first channel and exhaust (second air flow) channel chamber respectively as previously described. Alternatively, the electrode planes could be configured horizontally, wherein the flow of charged droplets and ionized contaminants would interact in a direction perpendicular, or at a 90° angle, to the direction of the force of gravity. In this scenario, the electrode planes could be set up at any angle with respect to the force of gravity. Other alternative embodiments are also possible. For example, airflow can into the first channel or chamber in a direction other than 90° to the electrode planes, or the air flow could be directed into the channel in such a way so that there is more turbulence/mixing to enhance the exposure of air contaminants to the droplets. In an exemplary embodiment, the transition from laminar to turbulent or circulating flow can be accomplished by incorporating an appropriately shaped fin or deflector plate into the incoming air stream and this could contribute to a higher purification efficiency by increasing the residence time of the air within the first air flow channel or chamber.

Figure 18:
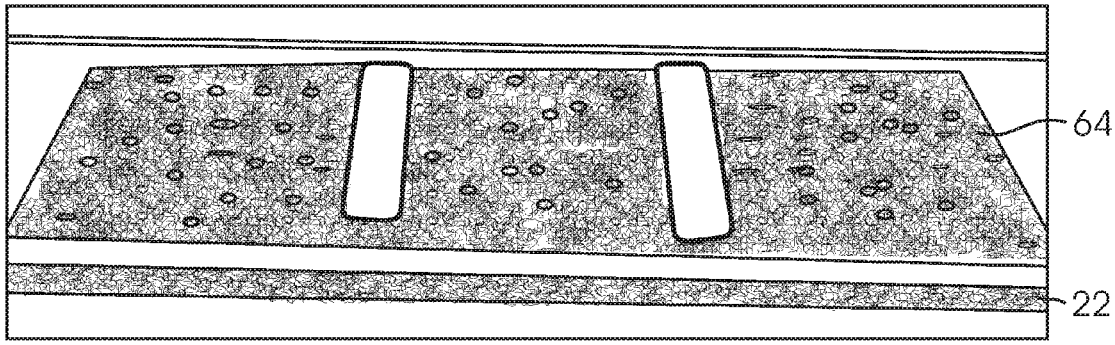
FIG. 18 is an illustration of a close up depiction of an exemplary array of emitters as used in an embodiment of the claimed subject matter.

FIG. 18 illustrates an array of discreet charged droplet emitters placed in flow connection with a solvent reservoir 22. In use, the liquid solvent moves from the reservoir 22 through the solvent reservoir 22 into the core of the wick by capillary flow and is dispersed from the end of the tip of the wick. Since the solvent is electrically conducting, all of the solvent within the solvent reservoir 22 becomes charged by the high voltage electrode (V1). The electrospray emitters array 64 serves to form sharp focal points of solvent for exposure to the electric field in the first upper chamber. The electric field disperses the liquid arriving at the tip of the emitters 64 into a fine spray of charged droplets, which ionize the contaminants of the incoming air flow. Although the emitter array 64 as shown in the current embodiment consists of the nylon fiber wicks threaded through the quartz capillary tubes, it may be possible to eliminate the capillary tubes and instead use a simpler design consisting of individual bare wicks protruding from the solvent reservoir 22 or a solvent pad 44. The solvent pad 44 and emitter array 64 should ideally cover the entire air flow channel base or floor so that there are no "dead" areas within the air channel volume through which the contaminants in the air flow can leak without coming into contact with the electrospray droplets.

The collection and purification efficiencies of the apparatus will depend on the number of charged droplet emitters per unit surface area. This emitter density depends on the geometry and nature of each emitter and also on the electric field magnitude. One embodiment has 75 emitters in a surface area of approximately 200 $cm^2$. However, other configurations with higher or lower emitter densities are also possible. Because the emitter density and surface area exposed to the contaminated air flow need to be maximized in the air purification system to maximize the efficiency of ionization and collection of the contaminants particles and molecules, solvent evaporation becomes an important issue. As previously discussed, the solvent reservoir 22 can be sealed to minimize evaporation, while still allowing the emitters 64 to be in contact with the contaminated air flow. In several embodiments, the reservoir 22 is sealed by sealing the liquid solvent reservoir 22 and corresponding solvent pad 44 in a plastic housing. As stated before, the portion of the housing in contact with the air flow contains a plurality of small holes, and the wicks of these emitters 64 emerge through these small holes.

Figure 19:
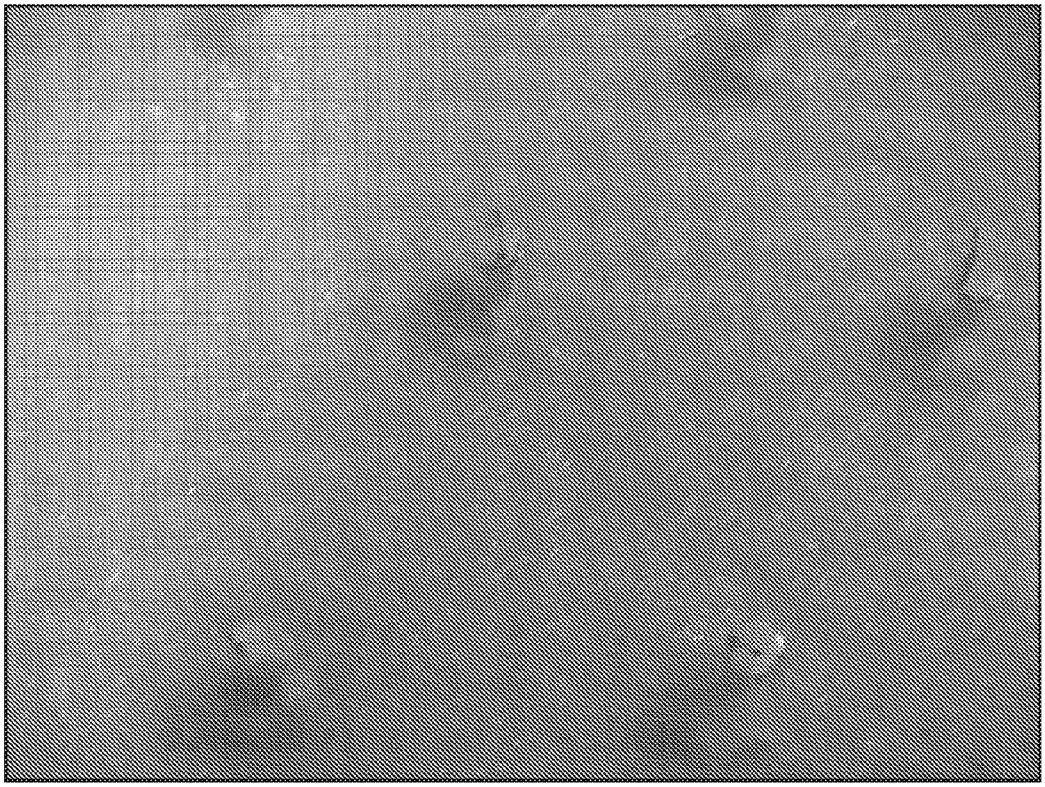
FIG. 19 is a close up view of an emitter array of wicks as used in an embodiment of the claimed subject matter.

In a close up view of an embodiment, FIG. 19 shows an emitter array of wicks in a exemplary configuration that may be used as an electrospray source emitter array. In this embodiment, each discrete source emitter consists of a capillary tube fed by a wick inserted into the center and connected to the solvent reservoir 22 via a solvent pad 44. In this embodiment, each electrospray emitter 16 is composed of a wick inserted into a small quartz capillary tube. The wick may be constructed of any wettable fibrous material, and the wick would be placed in continuous contact with the source of liquid solvent via its interaction with a wet absorbent "sponge" or solvent pad 44 which itself is fed by the liquid solvent reservoir 22. In some embodiments, Nylon dental floss was successfully used as the wick material and the sponge like solvent pad 44 was constructed of a polyester pad which was purchased commercially from McMaster-Carr.

As previously mentioned, certain features and components of embodiments of the claimed subject matter have been shown and described. These embodiments are not intended to limit the claimed subject matter, since it will be understood that various omissions, modifications, substitutions and changes in the forms and details of the illustrated embodiments may be made by those skilled in the art without departing in any way from the spirit of the claimed subject matter.

What is claimed is:

1. A contaminant extraction method for removing contaminants from an air flow comprising:

the step of generating a first electric field in a first air flow channel and a second electric field in a second air flow channel wherein the channels are separated by an extraction grid and the second electric field is of a greater magnitude than the first electric field;

the step of generating a first air flow through the first air flow channel and a second air flow through a second air flow channel;

the step of dispensing charged liquid droplets into the first air flow using at least one charged droplet generator;

the step of allowing said charged liquid droplets to interact with particles and polar species in the first air flow so that charge is transferred to at least one particle or polar species; and the step of expelling said one or more charged particles into the second air flow using the potential difference in the second electric field.

2. The contaminant extraction method for removing contaminants from an air flow of claim 1 wherein the first air flow is a gas flow comprising a gas or gas mixture other than air.

3. The contaminant extraction method for removing contaminants from an air flow of claim 1 wherein the second air flow is a gas flow comprising a gas or gas mixture other than air.

4. The contaminant extraction method for removing contaminants from an air flow of claim 1 wherein the charged droplet generator is selected from one or more of the following group: a needle, wick, an emitter array, a discrete source emitter, a capillary tube fed by a wick, two or more capillary tubes of more than one diameter, and a pressure driven aerosol generator.

5. The contaminant extraction method for removing contaminants from an air flow of claim 1 wherein the source of the liquid solvent used to generate droplets in the charged droplet generator is selected from the following group: water and alcohol, a mixture of water and alcohol, water and an antibacterial compound, water mixed with alcohol and an antibacterial compound, water mixed with 10% alcohol and an amount of chlorine.

6. The contaminant extraction method for removing contaminants from an air flow of claim 1 wherein the magnitude of the second electric field is approximately two to three times the magnitude of the first electric field.

7. The contaminant extraction method for removing contaminants from an air flow of claim 1 further comprising the step of redirecting the output from the second air flow channel to the input of the inlet of the first air flow channel.

8. The contaminant extraction method for removing contaminants from an air flow of claim 1 wherein the output of the first air flow channel is released into one or more of the following group: a protected area, the environment, the interior of a house, a pressurized cylinder, a canister, and another first air flow channel.

9. The contaminant extraction method for removing contaminants from an air flow of claim 1 wherein the first electric field is generated from a set of electrodes connected to the charged droplet generator and the extraction grid and the second electric field is generated from an additional connection to the ground plane of the second channel.

10. The contaminant extraction method for removing contaminants from an air flow of claim 1 wherein the geometries of the first air flow channel and the second air flow channels are selected from the following group: planar, coaxial, and non planar.

11. The contaminant extraction method for removing contaminants from an air flow of claim 1 wherein at least one of the air flow channels is enclosed in a housing with an inlet and an outlet.

12. The contaminant extraction method for removing contaminants from an air flow of claim 1 wherein the charged droplets change from the liquid phase to the vapor phase before reaching the extraction grid.

13. The contaminant extraction method for removing contaminants from an air flow of claim 1 wherein the solvent is delivered to the charged droplet generator from solvent reservoir using capillary forces.

14. The contaminant extraction method for removing contaminants from an air flow of claim 13 wherein the solvent reservoir is made of an absorbent material such as a sponge.

15. The contaminant extraction method for removing contaminants from an air flow of claim 11 wherein the housing further contains a removable, cleanable collection plate.

16. The contaminant extraction method for removing contaminants from an air flow of claim 11 wherein the housing also includes an electrical interlock so that when the housing is opened or moved, power to the charged droplet generator and electrical field is stopped.

17. The contaminant extraction method for removing contaminants from an air flow of claim 1 wherein the airflow rate and charged droplet delivery rates are correlated for greater or maximum efficiency.

18. The contaminant extraction method for removing contaminants from an air flow of claim 1 using more than two multiple parallel air flow channels.

19. The contaminant extraction method for removing contaminants from an air flow of claim 15 wherein the contaminated particles removed from the collection plate are analyzed or characterized.

20. A contaminant extraction system for extracting contaminants from an air flow, comprising:

a first channel with an inlet and an outlet into which a first air flow is directed, said first air flow containing a plurality of contaminants;

a solvent reservoir containing a volume of solvent;

a charged droplet generator for using said solvent to produce a plurality of charged liquid droplets in said first channel;

a second channel with an inlet and an outlet into which a second air flow is directed;

an electric field generator for generating a first electric field in said first channel and for generating a second electric field in said second channel, wherein the second electric field is of a magnitude greater than the first electric field; and an extraction grid located between said first channel and said second channel;

wherein said charged liquid droplets are dispersed into said first channel allowing said plurality of contaminants in said first air flow to become charged;

and wherein said charged contaminants are expelled into said second air flow using the potential difference generated from the second electric field;

and wherein said second air flow containing said charged contaminants is expelled out of the second channel outlet and a purified air flow is expelled from the outlet of said first channel.

21. A contaminant extraction apparatus for extracting contaminants from an air flow, comprising:

a first channel with an inlet and an outlet into which a first air flow is directed, said first air flow containing a plurality of contaminants;

a solvent reservoir containing a volume of solvent;

a charged droplet generator for using said solvent to produce a plurality of charged liquid droplets in said first channel;

a second channel with an inlet and an outlet into which a second air flow is directed;

an electric field generator for generating a first electric field in said first channel and for generating a second electric field in said second channel, wherein the second electric field is of a magnitude greater than the first electric field; and an extraction grid located between said first channel and said second channel;

wherein said charged liquid droplets are dispersed into said first channel allowing said plurality of contaminants in said first air flow to become charged;

and wherein said charged contaminants are expelled into said second air flow using the potential difference generated from the second electric field;

and wherein said second air flow containing said charged contaminants is expelled out of the second channel outlet and a purified air flow is expelled from the outlet of said first channel.

* * * * *